US010746393B1

(12) United States Patent
White et al.

(10) Patent No.: US 10,746,393 B1
(45) Date of Patent: Aug. 18, 2020

(54) HARNESS VEST WITH PORTABLE SAFETY AND ILLUMINATION LIGHTING

(71) Applicants: Gary M. White, Columbia, SC (US); David White, Columbia, SC (US)

(72) Inventors: Gary M. White, Columbia, SC (US); David White, Columbia, SC (US)

( * ) Notice: Subject to any disclaimer, the term of this patent is extended or adjusted under 35 U.S.C. 154(b) by 189 days.

(21) Appl. No.: 15/955,339

(22) Filed: Apr. 17, 2018

Related U.S. Application Data

(63) Continuation-in-part of application No. 14/670,923, filed on Mar. 27, 2015, now abandoned.

(51) Int. Cl.

| | |
|---|---|
| ***F21V 33/00*** | (2006.01) |
| ***A41D 13/01*** | (2006.01) |
| ***F21V 7/00*** | (2006.01) |
| ***F21V 21/096*** | (2006.01) |
| ***F21V 23/06*** | (2006.01) |
| ***A41D 13/00*** | (2006.01) |
| ***A41D 1/00*** | (2018.01) |
| ***G08B 5/00*** | (2006.01) |
| ***G08B 5/36*** | (2006.01) |
| ***F21L 4/02*** | (2006.01) |
| ***H05B 45/20*** | (2020.01) |
| *F21Y 113/13* | (2016.01) |
| *F21Y 115/10* | (2016.01) |

(52) U.S. Cl.

CPC ..... *F21V 33/0008* (2013.01); *A41D 1/002* (2013.01); *A41D 13/0007* (2013.01); *A41D 13/01* (2013.01); *F21L 4/027* (2013.01); *F21V 7/0075* (2013.01); *F21V 21/0965* (2013.01); *F21V 23/06* (2013.01); *G08B 5/004* (2013.01); *G08B 5/36* (2013.01); *H05B 45/20* (2020.01); *A41D 2300/32* (2013.01); *A41D 2300/324* (2013.01); *A41D 2600/20* (2013.01); *F21Y 2113/13* (2016.08); *F21Y 2115/10* (2016.08)

(58) Field of Classification Search

CPC ..... A41D 2600/20; A41D 13/0007; A41D 13/01; F21V 33/0008; G08B 5/004

See application file for complete search history.

(56) References Cited

U.S. PATENT DOCUMENTS

| | | | | |
|---|---|---|---|---|
| 2002/0145864 | A1* | 10/2002 | Spearing | A41D 13/01 362/103 |
| 2007/0226871 | A1* | 10/2007 | Hood | A41D 1/002 2/69 |
| 2008/0043458 | A1* | 2/2008 | Desjardin | A41D 13/01 362/108 |

(Continued)

*Primary Examiner* — Cara E Rakowski
*Assistant Examiner* — Steven Y Horikoshi
(74) *Attorney, Agent, or Firm* — Nexsen Pruet LLC; Michael A. Mann

(57) ABSTRACT

A harness vest carries a lighting system for safety and utility. The vest includes holsters for light modules on front and back shoulder pads. The light modules may be removable or fixed LED strips attached to the front and back shoulder pads. Each lighting module is removable and is controlled by on/off buttons and front-mounted control panels for separate use as portable, personal, lighting devices. Modules are magnetic and may be removable from the harness best and attached to other surfaces for illuminating a work area. The user controls brightness, mode (such as strobe, strobe frequency), and color. The vest can be added to a reflector cover as part of a 5-point breakaway reflector vest.

17 Claims, 16 Drawing Sheets

(56) References Cited

U.S. PATENT DOCUMENTS

| | | | | |
|---|---|---|---|---|
| 2008/0089056 | A1* | 4/2008 | Grosjean | B60Q 1/2673<br>362/103 |
| 2011/0038142 | A1* | 2/2011 | Ritter | F21V 21/145<br>362/108 |
| 2012/0272427 | A1* | 11/2012 | Scozzafava | A41D 7/00<br>2/67 |

* cited by examiner

HARNESS VEST WITH PORTABLE SAFETY AND ILLUMINATION LIGHTING

TECHNOLOGICAL FIELD

The present disclosure relates generally to safety and utility apparel and, in particular, to vests carrying lighting.

BACKGROUND

Many of our day-to-day activities are uneventful. We go to work and sit at our desk doing our daily duties, answering a few phone calls, emails, and sorting through paper work before rushing out in time to pick up dinner and the kids on the way home. As the day draws to an end, so does the daylight and the skies darken. Headlights crowd the highway and brake lights march into the horizon. Road Crews flood the widened shoulders and narrowed lanes. A police officer, working a roadside accident, navigates traffic around the debris and wreckage. Fire Fighters work to rescue a woman and child from a vehicle while emergency medical service personnel are attempting to revive another. After all of the victims are stable and on their way to the hospital, a tow truck arrives. The operator gets out, sweeps up the broken pieces, and connects the wreckage to his rollback to drag it up onto the flatbed. All of these events are happening in a hostile environment where moving cars, distracted drivers, and low lighting are a recipe for disaster. Not being seen, as well as not having lighting to perform the task at hand exposes these first responders to elevated risk. The officer working the traffic accident may not be visible in the darkness by an oncoming car; the emergency medical technician is having trouble finding a vein to start intravenous fluids while holding a flashlight between neck and shoulder; fire fighters do not have enough light to see what is trapping a victim in the vehicle; and a tow truck operator is having difficulty seeing to hook up the wrecked vehicle to the pull wench. If he turns on the bright lights in order to see the rollback, he may blind approaching drivers that are trying to navigate around the wreckage, while flashing lights from police cars add to the confusion and make it difficult to perceive detail.

There are other examples. There are various solutions for the problem of seeing in low or no light, ranging from flashlights, lanterns, and floodlights for roadside work, to light-emitting diodes attached to a headband. All of these are useful but are not readily adaptable to every circumstance.

SUMMARY

According to its major aspects and briefly described, the present device is a harness vest carrying a portable lighting system for safety and utility lighting. In one embodiment, the present invention is a harness-like vest with holsters that carry light modules and or LED strips. The LED strips and light modules are controllable so that the mode of illumination—steady bright light or flashing light—can be selected by the user. The LED strips or light modules in the holsters on the back of the vest may be used to provide safety lighting for the wearer. Those on the front may also provide both safety lighting as well as utility lighting, that is, lighting for tasks being performed by the wearer.

The vest is harness-like, that is, it is made to be brief and ride high on the wearer's chest, covering just the shoulders of the upper torso, and be just sufficient in size to hold the modules or LED strips, but not so large as to provide extensive body coverage so that the vest interferes with other gear carried or worn by the user (such as body armor worn by police). The configuration of the vest also allows the user to have use of its lighting for hands-free operation.

Each module is removable, that is, it is releasable from the vest and has magnets inside that can be used to stick the LED module on any metal surface such as, for example, the inside of the hood of a car engine compartment, and be easily removable after use, without damaging the metal surface or the module.

The light produced by the LED strips and modules may be selected and controlled by the user in a number of different ways. The front lighting source is an ultra-bright, white LED system that is intended to be used as for hands-free task lighting, or alternatively, as a signaling strobe. LED strips on the back of the vest come in several colors: red, blue, green, yellow, and orange. LEDs strips for the modules may have the ability to change colors. Both LED strips and modules worn on the back of the harness vest may be used in continuous mode or as signaling strobe mode. The brightness, the mode (i.e., continuous mode or strobe mode), and the frequency of flashes in strobe may be controlled by the wearer of the present harness vest either by control buttons on the light module or by pressing a control button carried elsewhere on the vest. LED strips, which are fixed to the vest and, unlike the modules themselves, are not removable, are only controlled from the control panel and an on/off button on the front of the vest.

An example of the present vest suitable for police vest may have utility white LEDs on the front, and blue LEDs on the back that strobe at a moderate frequency. The white LEDs on the front can illuminate a suspect or be used to inspect a license and vehicle registration. The flashing blue lighting on the back can warn others that police (as suggested by the color blue) are at work and that others should stay clear.

Another example of the present vest is an Emergency Medical Service (EMS) worker's vest for use in assisting accident victims. The front of the vest may have white LEDs in a brightest setting to illuminate the victim, for example, for finding a vein to use for starting an intravenous blood transfusion. The vest carries red LEDs on the back of the vest to warn others of the presence of EMS workers. The LEDs may be waterproof or carried within a button that provides a waterproof housing that holds the LED so that they are clearly visible.

These and other features and their advantages will be readily apparent to those skilled in the art of safety and utility lighting, from a careful reading of the Detailed Description, accompanied by the following drawings.

BRIEF DESCRIPTION OF THE DRAWINGS

In the drawings,

FIG. 6A is a front view of the reflector covers with plastic windows that allow the light from LEDs on LED vest to shine through;

DETAILED DESCRIPTION

Referring now to the figures, a harness vest 10 is made of a serviceable material such as nylon fabric that can resist stress in the environment of use. Vest 10 has four segments: two front shoulder pads 14 and two back shoulder pads 18, shown in FIGS. 1A and 1B. Shoulder pads 14, 18, are "holster"-shaped and spread out so that the upper portion of vest 10, as shown, including both back shoulder pads 18, ride on the upper back and shoulders of the wearer, and the lower portion of vest 10, including both front shoulder pads 14, ride on the upper chest and shoulders of the wearer, with the head of the wearer between both the upper and lower portions and left and right portions. For added strength and to prevent fraying, piping may be applied to the perimeter of shoulder pads 14, 18. For comfort, padding and felt are added to the wearer-contacting surfaces of shoulder pads 14, 18, respectively.

Vest 10 is a harness-type, that is, shoulder pads 14, 18 are shaped to be brief and straps are used hold them in position on the body. Shoulder pads 14, 18, are mounted high on the chest so as to cover only the upper torso and preferably being limited to both front and back of the shoulders of the wearer so as not to interfere with other gear or the clothing of the user. Significantly, shoulder movement is a better indication of human body movement. Accordingly, having light sources on the shoulders not only suggests that an object is illuminated but, when the wearer moves, suggests a moving human being.

Two shoulder adjustment links 22 enable the wearer to connect together front and back shoulder pads 14, 18 to fit the wearer. Links 22 attach to front and back shoulder pads 14, 18, in any of a variety of ways, including hook and loop fasteners, such as those sold under the trademark VELCRO by Velcro Industries B.V., which are preferred because they adjust readily in two dimensions and a range of angles.

Figure 8:
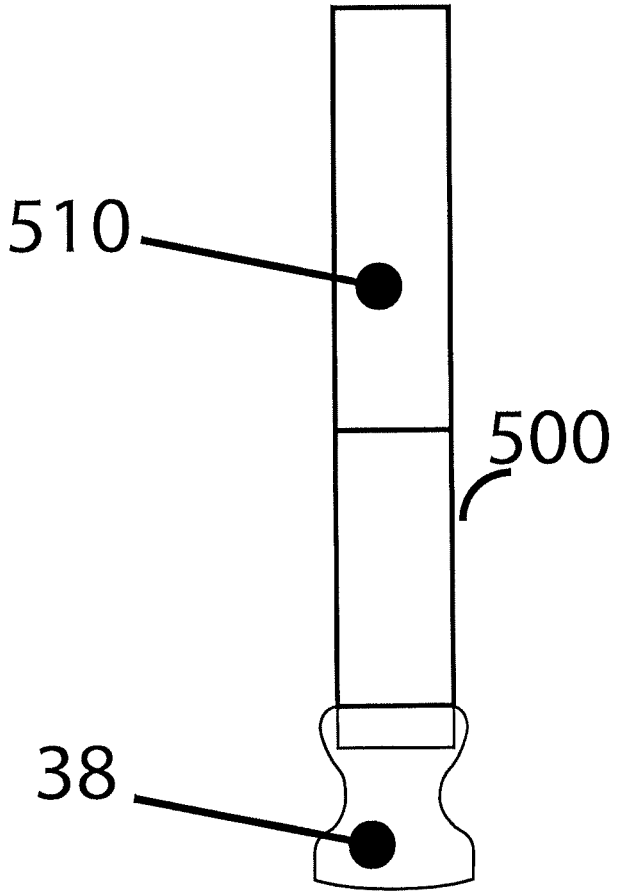
FIG. 8 is a view of the molly/backpack strap that is used to attach the LED vest to a bullet proof vest or to a backpack.

Back shoulder pads 18 are connected together by a ring connector 30. Rear and front shoulder pads 14, 18, are connected using two side adjustment straps 34 that are connected to shoulder pads 14, 18, using any convenient fastener, such as quick-release connectors 38 that snap together, as best seen in FIG. 1B. Quick-release connectors 46, 38, respectively, are located on the front of each of shoulder pads 14 and to each rear shoulder pads 18 and that attach to underarm straps 34 or to molly/backpack straps with quick-release connectors 38. A quick-release connector 38 and molly/backpack strap 500 as shown in FIG. 8 can replace underarm strap 34 to allow the LED vest 10 to be strapped to a molly/backpack system (webbing system on bullet proof vest with or without bulletproof plates) or to the straps on a typical backpack. Molly/backpack strap 500 has hook-and-loop fasteners 510 (also shown in FIG. 8) that allow the strap to be secured to itself to attach to Molly web or backpack straps. Side adjustment straps 34 run under the arms of the user to connect the front and back of vest 10. Front straps 42 are located on the front of vest 10 to connect front shoulder pads 14 together. Front straps 42 are adjustable and have a quick-release connector 38 with its two parts shown separated in FIGS. 1A and 1B, to secure vest 10 across the chest of user.

Figure 3B:
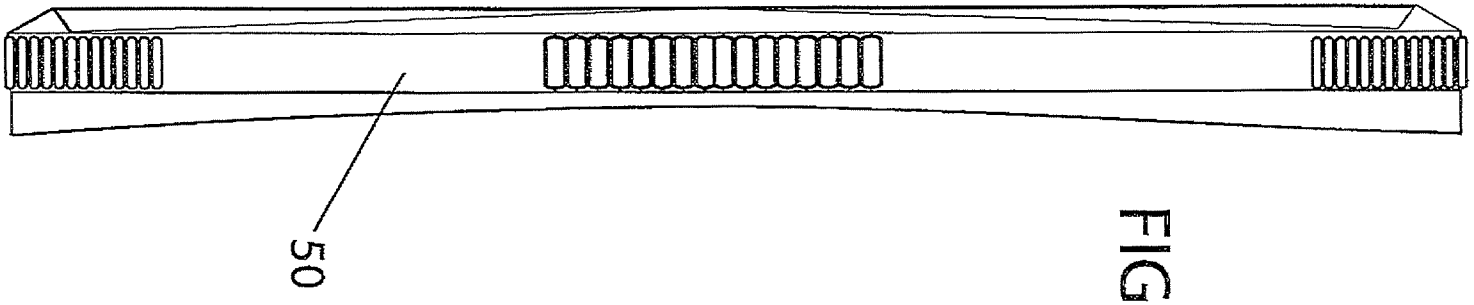
Figure 4A:
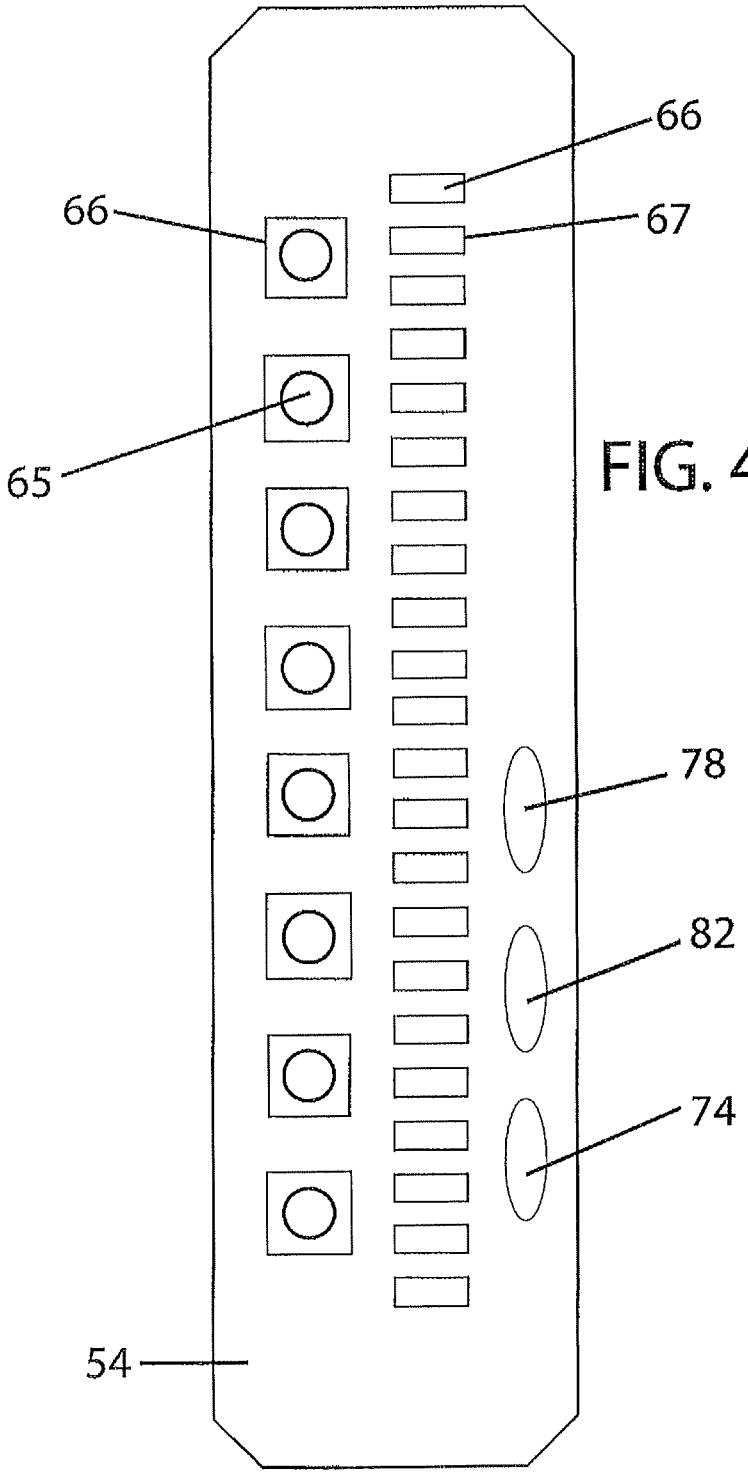
FIGS. 4A and 4B are front and back views of a light module, respectively, according to an aspect of the disclosure.
Figure 4B:
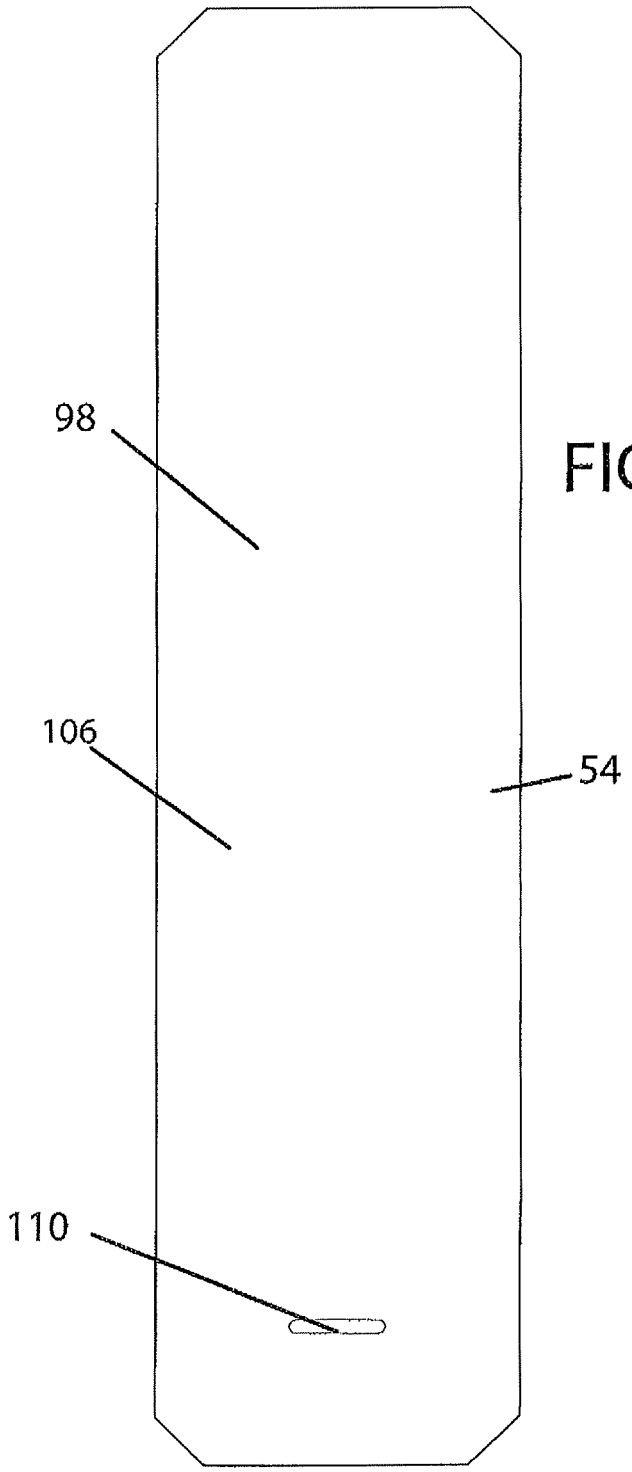

Front and back shoulder pads 14, 18 carry holsters 50 for holding a removable light module 54 with one LED strip 52. Each LED strip 52 has 4 LEDs, and is made of plastic and riveted to the vest 10 from the inside. Holsters 50 are curved (as best seen in FIG. 3B) to better conform to the shoulder of the user. Inside each LED strip 52 there is a metal heat sink. Holster 50 has metal surface inside for a magnet 98 to seat a removable module 54 into holster 50, as best seen in FIG. 4B. Magnet 98 enables module 54 to be removed from holster 50 and applied temporarily to any suitable, metal surface for shining the LEDs onto a work area.

Two holsters 50 are mounted to the back of vest 10, one on each back shoulder pad 18 and positioned at an angle with respect to each other, that is, with the tops of holsters 50 closer to each other. Light modules 54 held by holsters 50 or LED strips 52 that are located on back pads 18 are generally used for safety purposes, that is, to provide light signals to alert others that they are approaching the wearer of vest 10 rather than to provide utility lighting for the wearer. LEDs 66 (see in particular FIG. 4A) in each of these light modules 54 may also be used to convey information about the wearer's function. For example, the color of the LED module 54 may be selected to indicate the type of wearer, such as blue for police and red for fire fighters and yellow for EMS personnel. Yellow is also useful color for pedestrians and green may be used by hunters. LED strips 52 are a single color and cannot change color from their original color (which is selected at the time of manufacturing). LEDs in LED strips 52 or modules 54 may be waterproof or housed in a waterproof holder so that vest 10 would be wearable in wet weather and be washable.

Two holsters 50 are mounted to the front of vest 10 on front shoulder pads 14. Holsters 50 may be oriented vertically and the color of the light modules 54 carried by holsters 50 may be selected for utility lighting, or, alternatively, LED strips 52 may be oriented vertically on shoulder pads 14 for utility lighting. Utility lighting for LED strips 52 may be white LEDs 65 but may alternatively be blue LEDs 67 to preserve night vision while providing a level of light above ambient light.

Light modules 54 may be rectangular and made of a plastic such as engineering grade nylon or carbon fiber. Light modules 54 may carry plural LEDs 66.

Figure 1A:
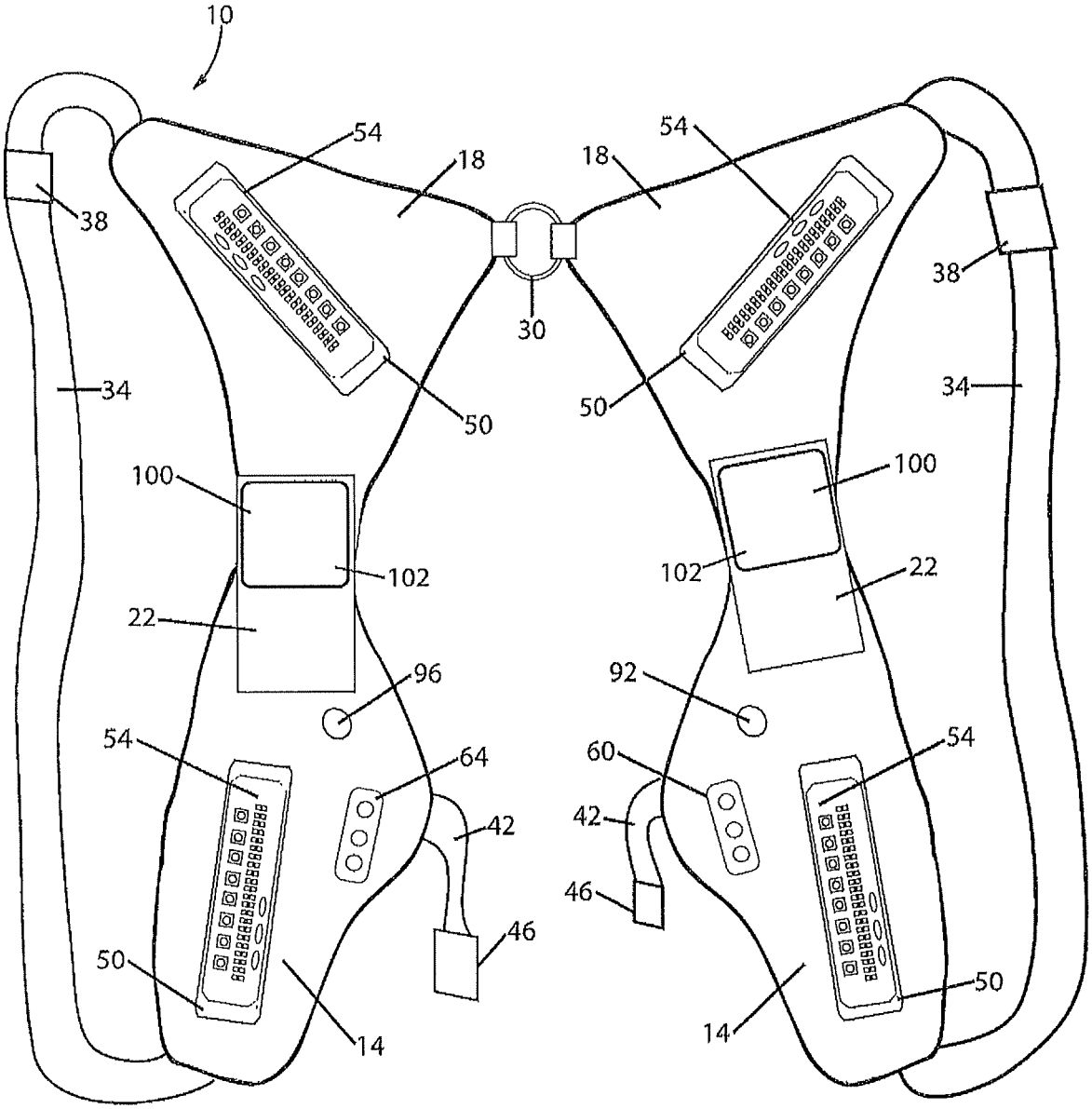
FIG. 1A is a top view of a harness vest with light modules inserted, according to an aspect of the disclosure.
Figure 1B:
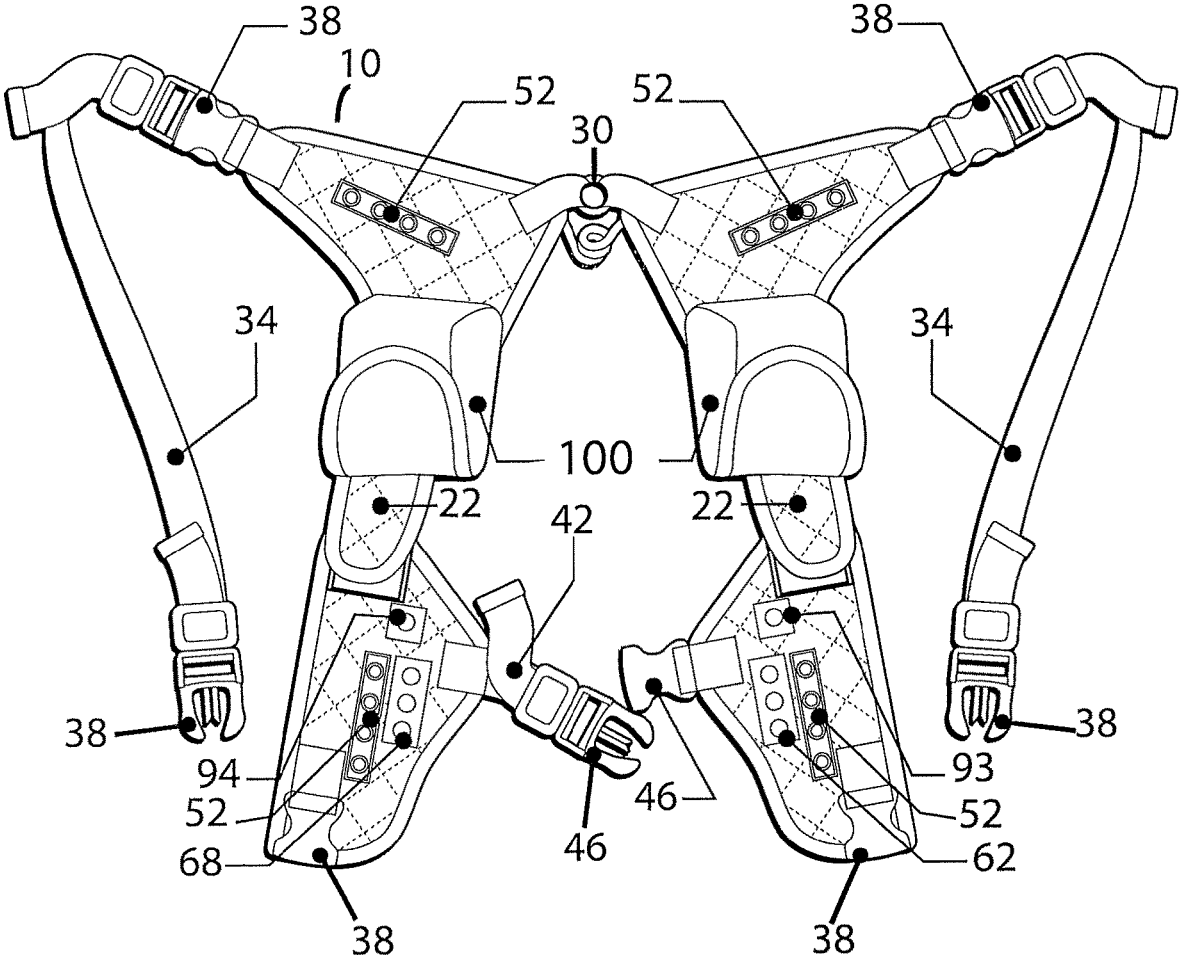
FIG. 1B is a top view of a harness vest with LED strips, according to an aspect of the disclosure.
Figure 2:
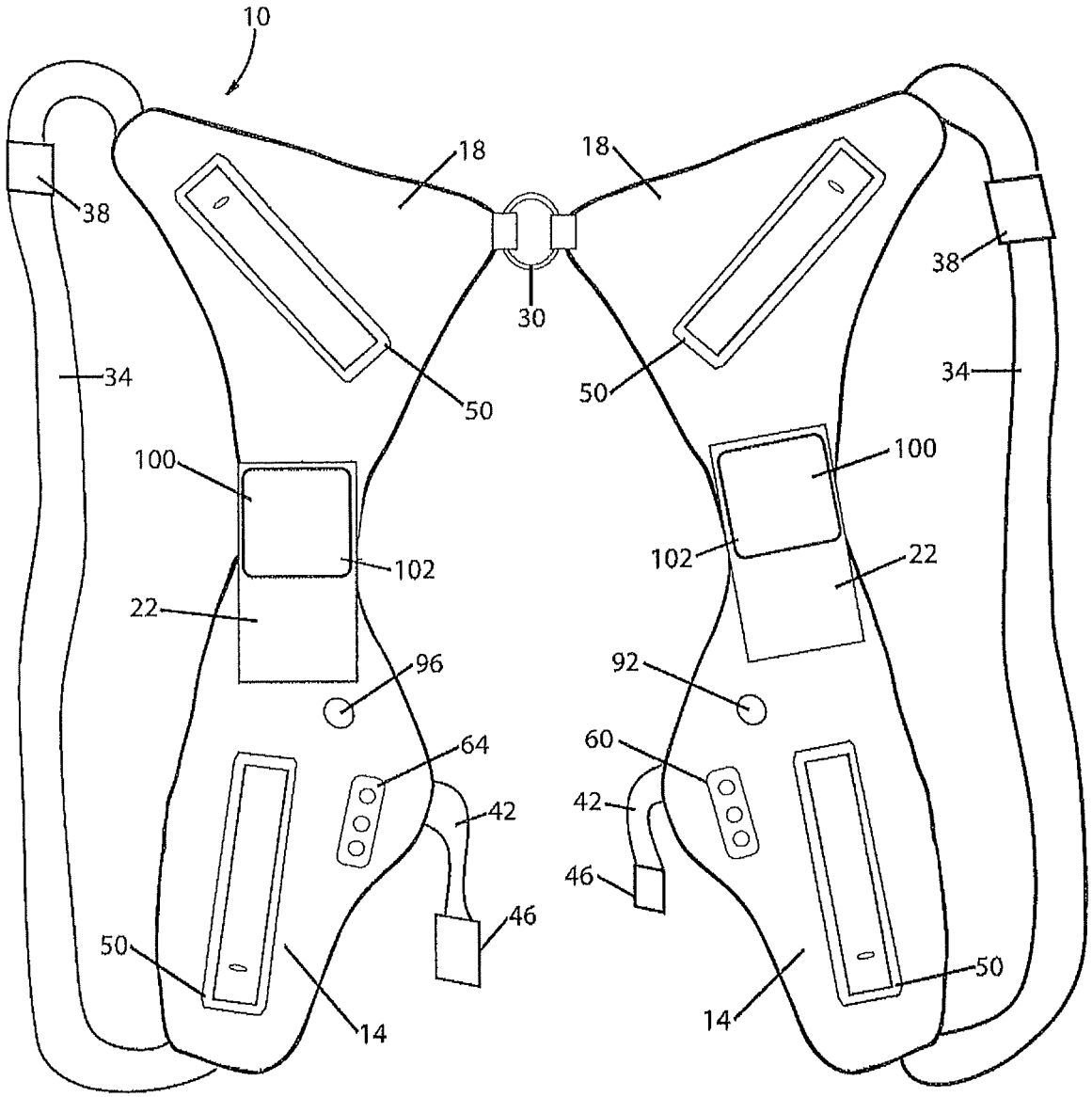
FIG. 2 is a top view of a harness vest of FIG. 1 but without light modules inserted, according to an aspect of the disclosure.

Control of light modules 54 located on the shoulder pads 18 is provided by control pad 64, located on front right pad 14 (as seen on FIG. 1A). Control of LED strips 52 is located on shoulder pads 18 but may also be provided by control pad 68, located on front right pad 14 (as seen on FIG. 1B). Control of modules 54 on the front shoulder pads 14 is provided by control pad 60, located on front left shoulder pad 14 (as seen on FIG. 1A). Finally, control of LED strips 52 is located on front shoulder pads 14 and may be controlled by control pad 62, located on front left shoulder pad 14 (as seen on FIG. 1B).

Figure 5A:
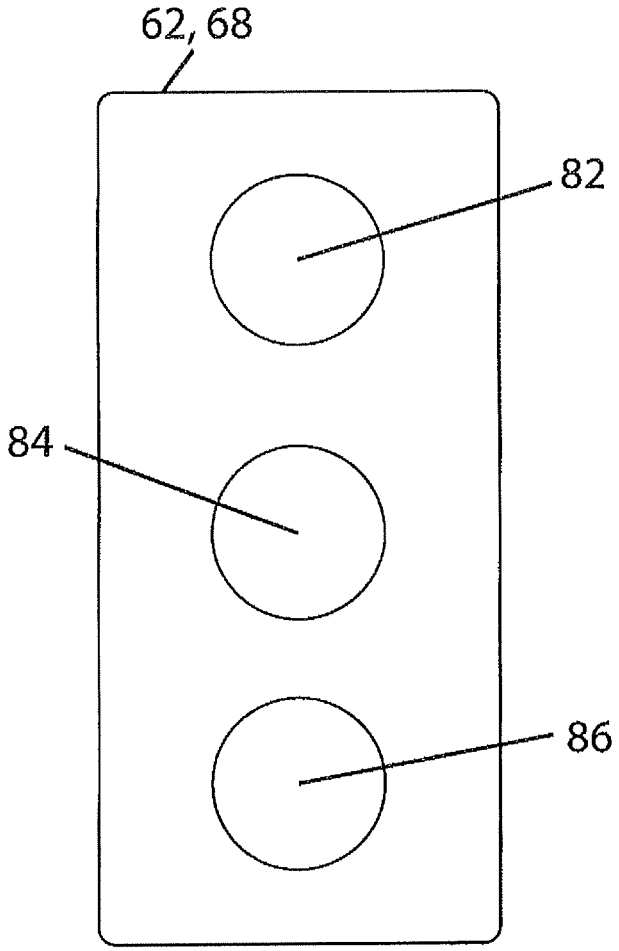
FIG. 5A is a front view of a LED control pad for the harness vest with LED strips fixed to the vest, according to an aspect of the disclosure.
Figure 5B:
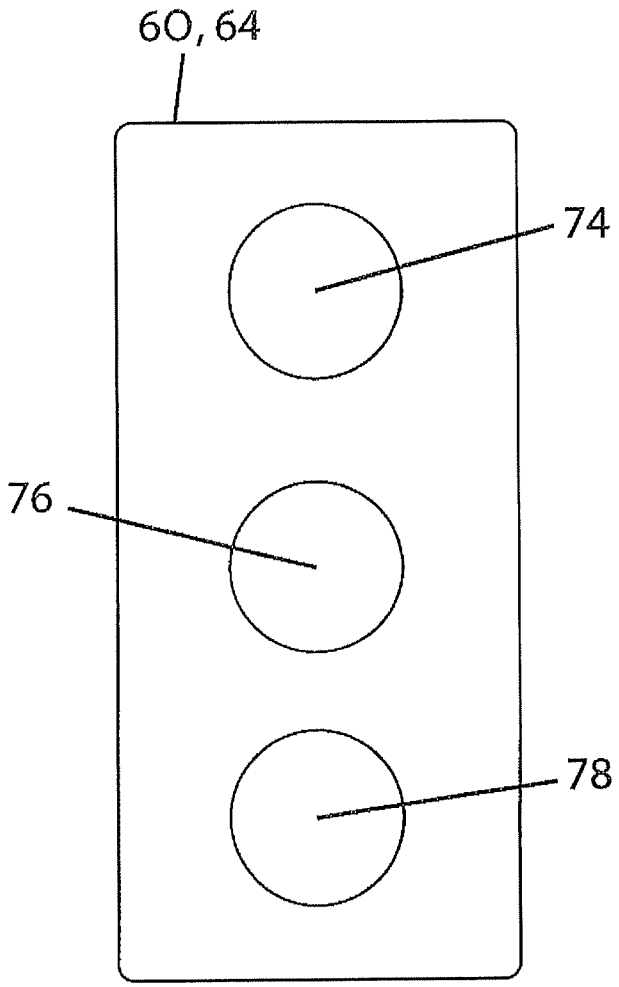
FIG. 5B is a front view of a LED control pad for the harness vest with light modules, according to an aspect of the disclosure.

Control pad 60 and 64 controls modules 54 with a dimming button 74, strobe select/constant light 76, and color change 78, respectively as seen in FIG. 5A. Pressing color select button 78 carried by modules 54 enables the user to change the color of the LEDs by selecting white LEDs 65 to emit white light (task lighting), or selecting RGB LEDs 67 to emit other colors (red, green, blue, yellow, and or orange). Control pads 62, 68 control LED strips 52 using buttons for dimming 82, strobe operation 84, and constant lighting button 86 (but not color change) as seen in FIG. 5B.

The control buttons on the front of LED modules 54 have the same functions as the buttons on control pads 60, 64, that is, a dimming button 74, a strobe select/constant light 76, and color change button 78. When modules 54 are removed from holsters 50, function buttons 74, 76, and 78, on module 54 are operative on the lights of LED modules 54, but when modules 54 are reinstalled in holsters 50, buttons 74, 76, 78, on control pads 60, 64 control the LEDs of LED modules 54.

Button 92 and 96, located on opposing front shoulder pads 14, are in electrical communication with control pads 60, 62, 64, 68. The wearer of vest 10 may activate button 92 to change the mode of modules 54 on the front shoulder pads 14, and activate button 94 to change the modules 54 on the back shoulder pads 18. Similarly, press button 93 to change the mode of LED strips 52 on the front to shoulder pads 14 and button 94 to change the mode of LED light strips 52 on back shoulder pads 18.

Battery packs 100 are located on the high shoulder area of back pads 18 to provide on/off buttons 92, 93, 94, 96 and control pads 60, 62, 64, 68, with electricity to operate modules 54 and LED strips 52. Battery packs 100 have a universal service bus (USB) charging/control port 102 used to recharge the system when rechargeable batteries are used. A suitable charger may be similar to a cellphone charger. Charging of the full system, including modules 54, can be achieved by plugging the charger into battery pack 100 using charging port 102.

A battery enclosure 106 is provided inside of light module 54 along with lighting electrical circuitry and another charging/control port 110, located on the back of light module 54 for recharging the rechargeable battery (if rechargeable batteries are inserted in battery compartment 106) and to relay communication between control pads 60, 64 to light module 54.

Figure 3A:
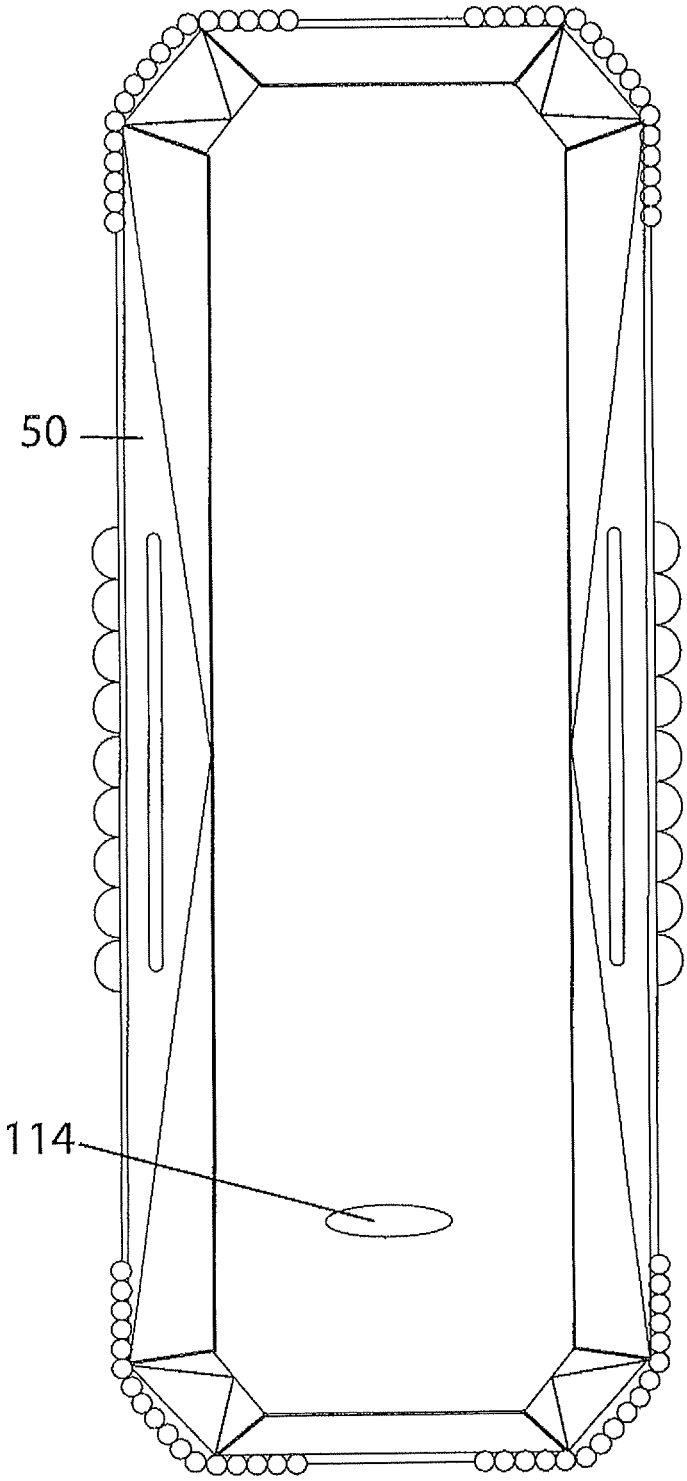
FIGS. 3A and 3B are front view and side views of a holster, according to an aspect of the disclosure.

Port 110 connects to charging/control plug 114 located on the inside of holster 50 (as seen in FIG. 3A) when module 54 is seated in holster 50. A battery in battery compartment 106 allows module 54 to be removed from vest 10 and used under its own power battery power for an extended time. For example, a fire fighter may remove a module and set it to red in strobe mode, placing it on the ground to simulate a road flare. When removed, module 54 may be charged directly though its charging/control plug.

Strobe/continuous lighting button 76 on control pad 60, 64 (FIG. 5B) enables LEDs 66 on modules 54 to operate in strobe mode and controls the duration and type of flash, ranging from a short flash, a long flash, fading flash, and constant light.

Strobe button 84 on control pad 68 (FIG. 5A) enables LED strips 52 to operate in strobe mode and controls the duration and type of flash, ranging from a short flash, a long flash, and fading flash.

Dimmer buttons 74 and 82 (FIG. 5A, 5B) controls the brightness of LEDs 66 on modules 54 and LED strips 52, respectively. This operation is available when the modules 54 or LED strips 52 are in strobe or constant lighting mode.

Color change button 78 (FIG. 5B) on control pad 64 controls selecting the color emitted by modules 54.

Constant lighting button 86 (FIG. 5A) on control pad 68 controls placing LED strips 52 into a constant lighting mode.

Modules 54, LED strips 52 mounted on the front of vest 10 are typically used for task lighting (white LEDs 65). Flood lighting produced by modules 54 or LED strips 52 makes it possible to see hands-free, but is not limited to just task lighting. Strobing of LED strips 52 or modules 54 may be selected or color change may be selected on the modules 54 of the vest 10 for safety strobes and for making a person visible to others. All holsters 50 are compatible with all modules 54 and can be changed out at will.

Figure 6A:
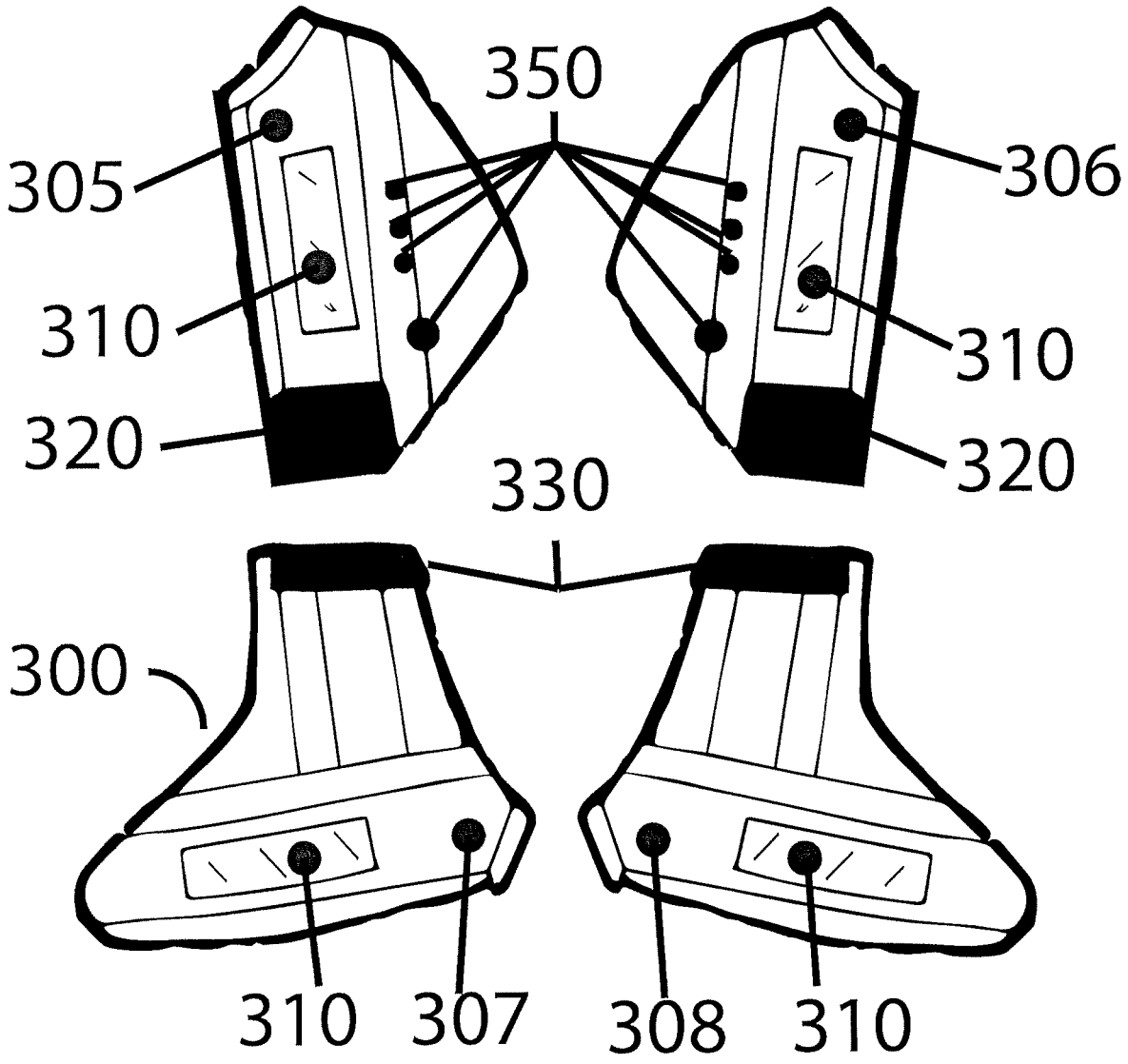
Figure 6B:
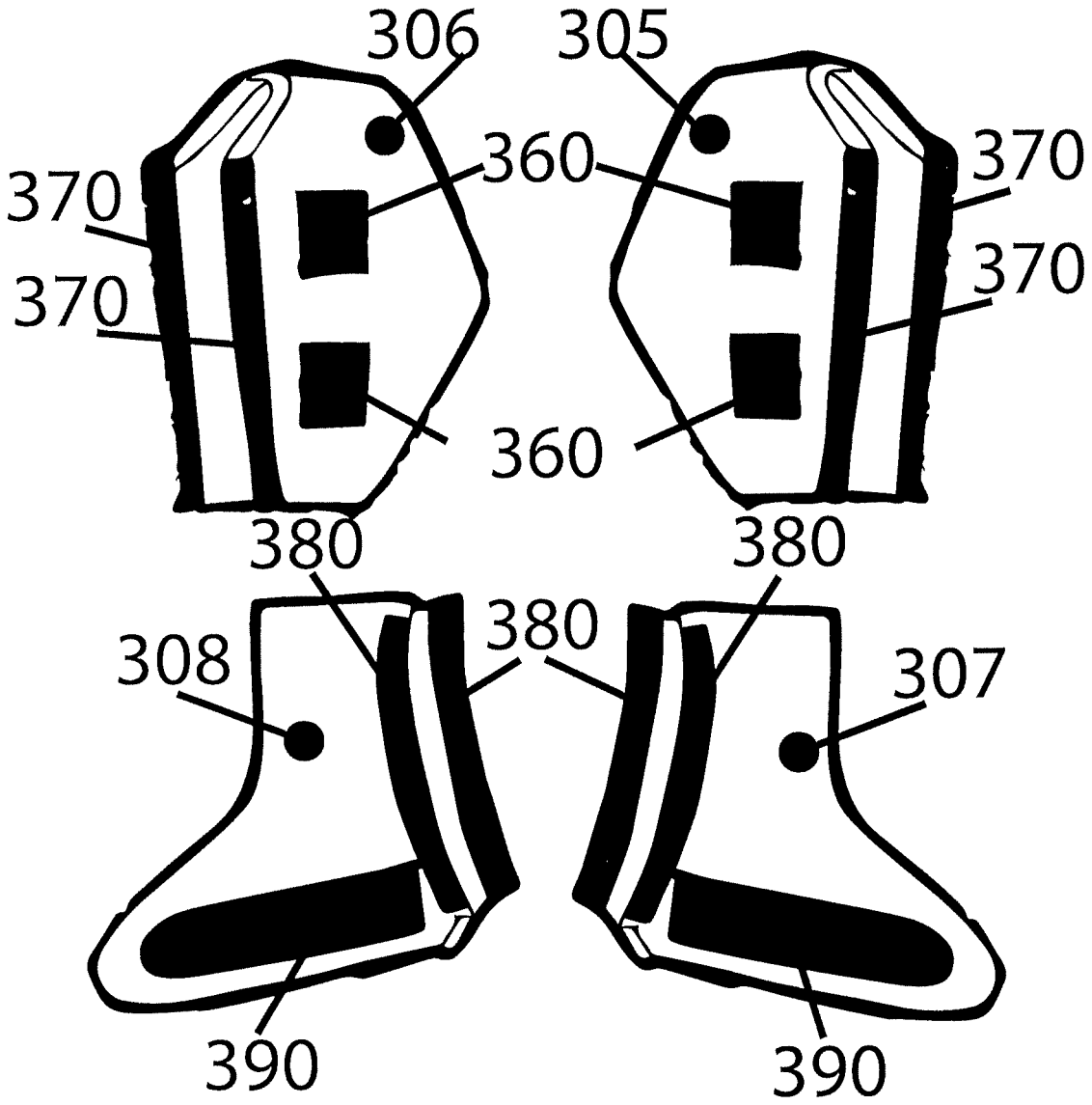
FIG. 6B shows the bottom side of the reflector covers and it's Velcro that attaches the reflector covers to the LED vest and reflector 5-point vest.
Figure 7A:
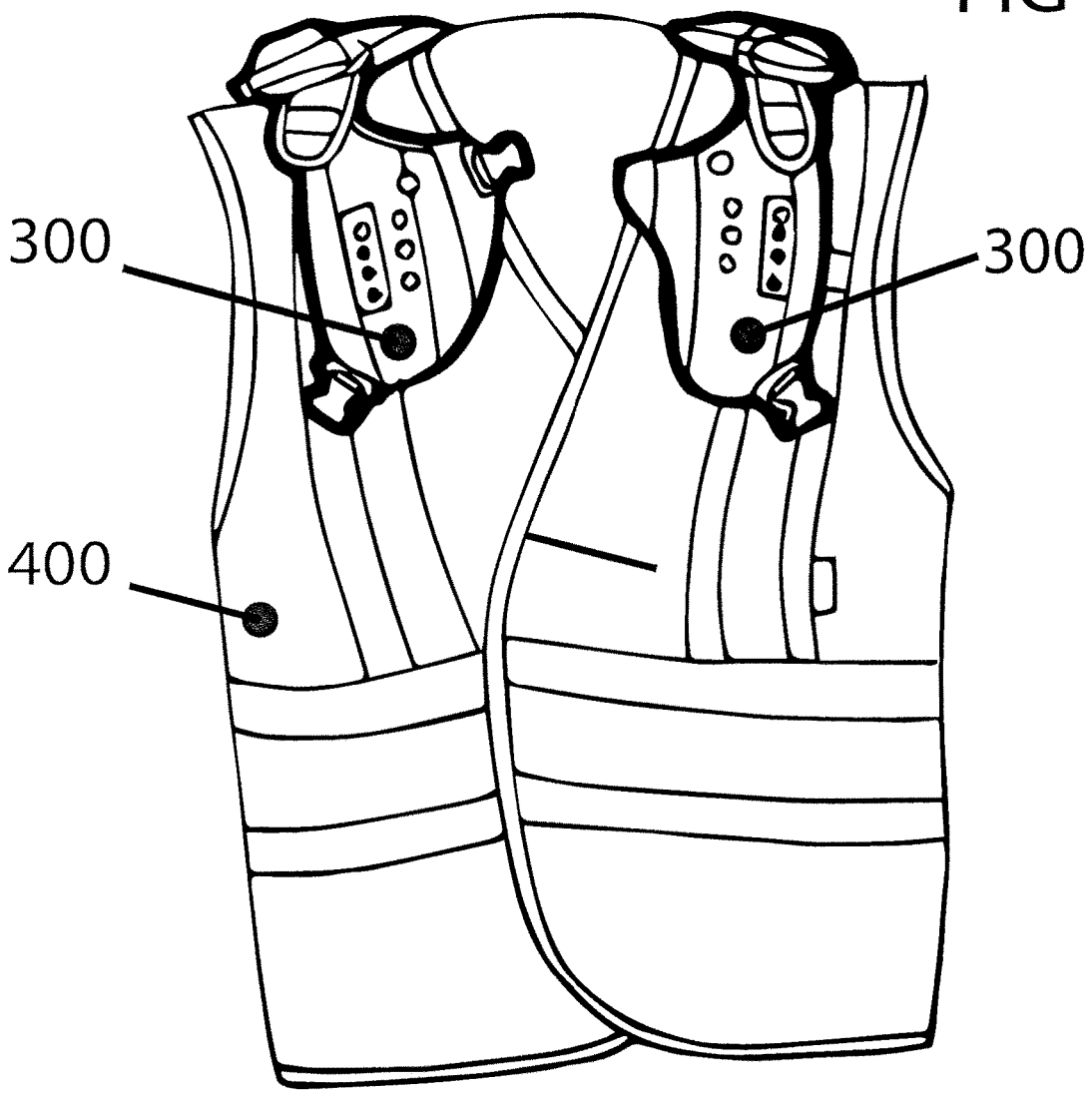
FIG. 7A is a front view of the LED vest with it's reflector covers attached to the 5-point reflector vest.
Figure 7B:
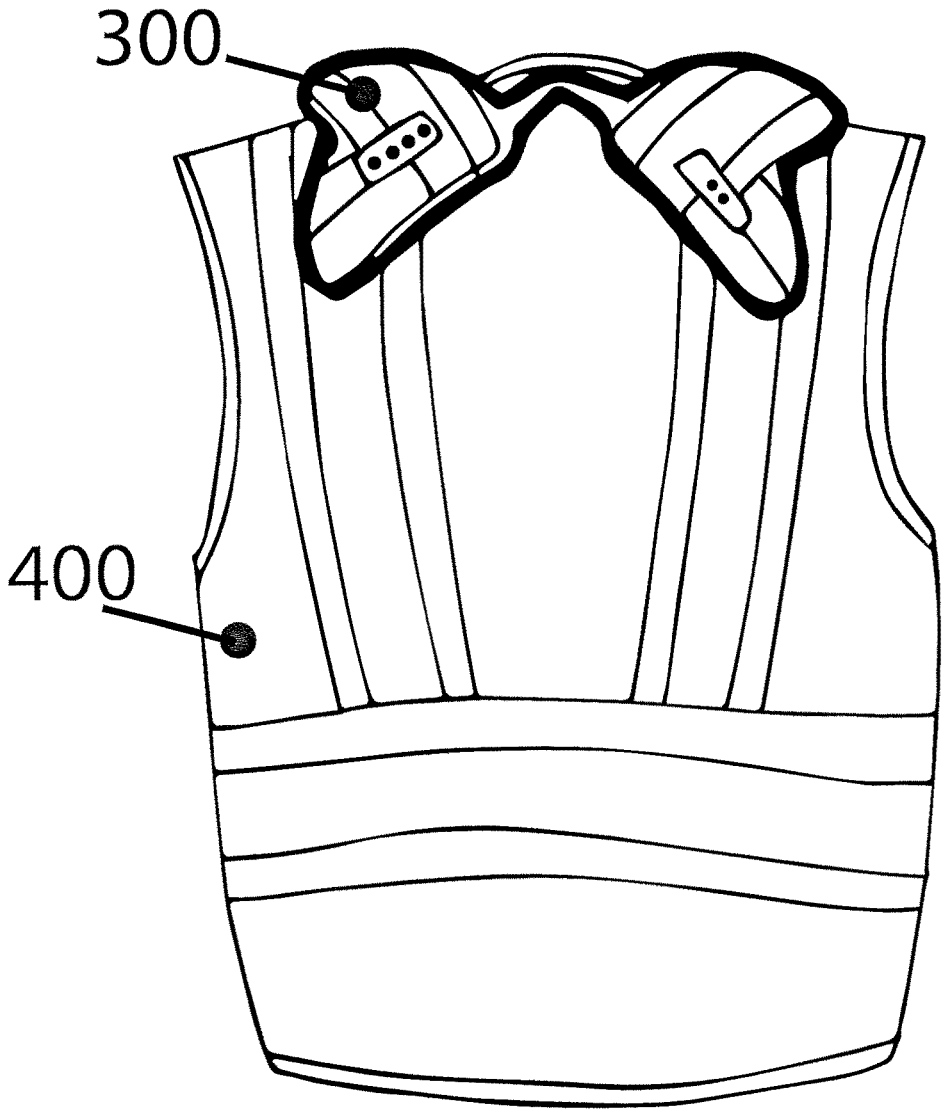
FIG. 7B is a rear view of the LED vest with it's reflector covers attached to the 5-point reflector vest.

Five-point vest 400 and reflector cover 300 are shown in FIGS. 7A and 7B. The reflector covers 306, 305, 308, 307 (see FIGS. 6A and 6B) wrap around the individual shoulder pads 14, 18, of vest 10 (front right, front left, back right and back left) with Velcro 370, 380 (FIG. 6B) to secure the covers in place. Encasing each shoulder pad 14, 18, and camouflaging the pads with the 5-point breakaway reflector vest 400.

Velcro 320 shown on FIG. 6A attach to over shoulder straps 22 shown on FIG. 1B to secure front and rear shoulder pads 14, 18, on vest 10. Velcro 330 (FIG. 6A) attach to battery pack 100 to secure covers 307, 308 to LED vest 10 back panels. The covers 300 are made of the same material as the reflector vest 400 and adds more reflective material to the LED vest, which replaces the reflective material that the LED vest 10 covers when attached to the 5-point reflector vest 400.

Figure 7C:
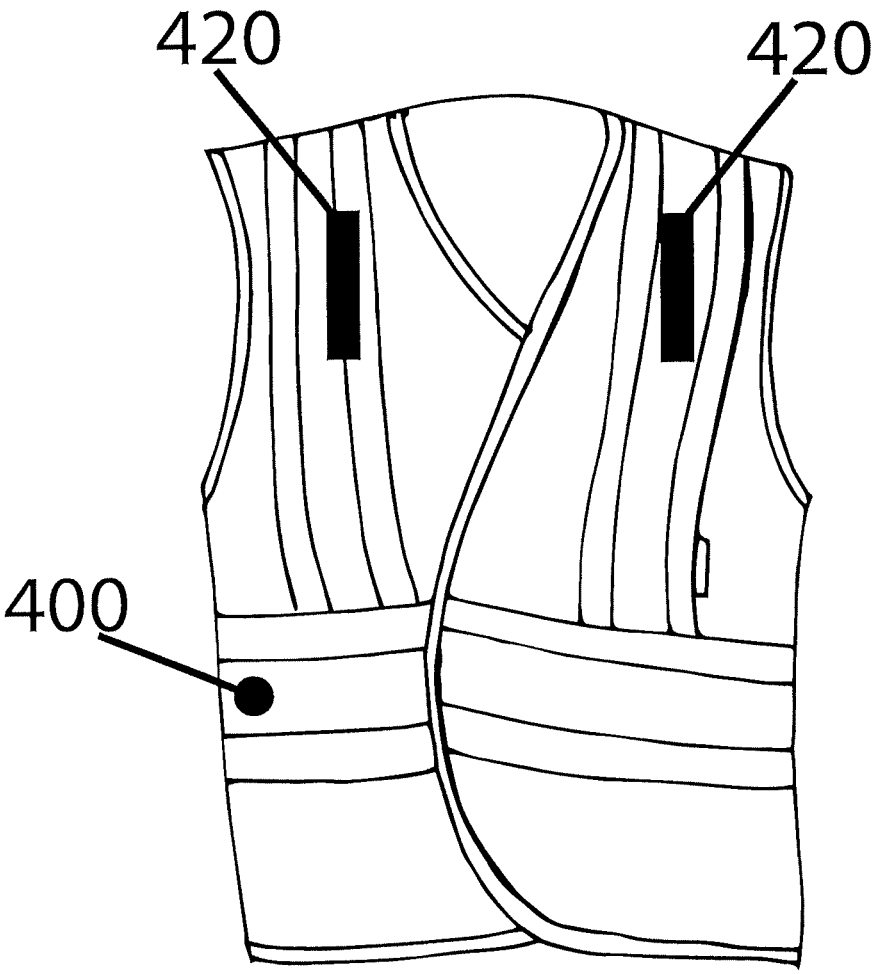
FIG. 7C is a front view of 5-point breakaway vest without LED vest with reflector covers.
Figure 7D:
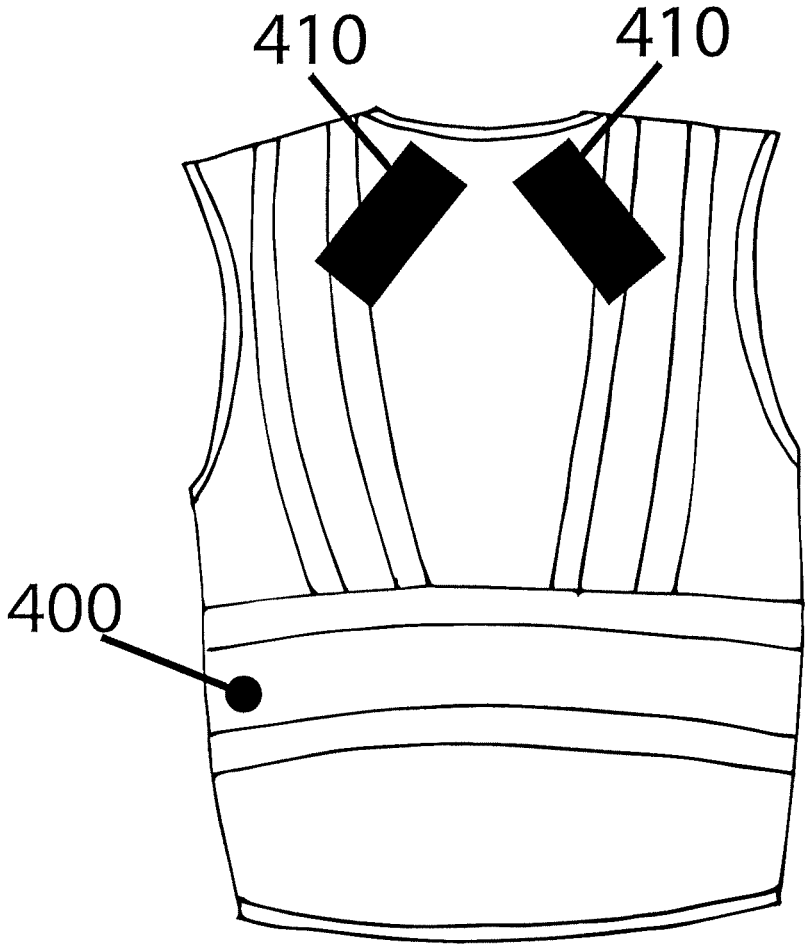
FIG. 7D is a back view of 5-point breakaway vest without LED vest with reflector covers.

The reflector covers 300 and 5-point vest 400 have hook and loop fasteners 360, 390 (FIG. 6B) that when the LED vest 10 is inside it's reflector covers 300 attaches to the LED vest 10 to the 5-point vest 400. The hook and loop fasteners 360, 370, 390 on the bottom side of reflector cover 300 as shown in FIG. 6B (attaching points between reflector covers 300 and the 5-point vest 400). The hook fasteners attach the loop fasteners 410 (FIG. 7D) located on the back of the 5-point vest 400 in a upside V formation with their closest point in the middle and high up near the neck. The back hook and loop fasteners 410 are wide and long strips giving more strength of attachment to the rear pads. The front covers have two small hook and loop fastener pads 360 (FIG. 6B) that attach to the upper chest of the 5-point vest 400 Velcro 420 (FIG. 7C) thereby giving the front shoulder pads 420 less strength of attachment. The rear hook and loop fasteners 410 have much more strength of attachment ensuring that in the event of the 5-point vest being snagged and a potential dragging action, the LED vest 10 will disconnect from the front of the 5-point vest 400 and will remain attached to the back panel of the 5-point vest, for true 5-point breakaway action.

The rear reflector covers 307, 308 (FIGS. 6A and 6B) ensure the rear quick releases 38 (FIG. 1B). This ensures that the LED vest 10 cannot be attached to the underarm adjustment straps 34 (FIGS. 1A and 1B) or any other strap or strapping that would restrict operation of the 5-point breakaway action of vest 10 and 5-point vest 400.

Each reflector cover 305, 306, 307, 308 has a plastic window 310 (FIG. 6A) that lines up over top of the LED strips 52 on its pad. This plastic window 310 allows the light from the LED strip 52 to pass through the cover uninhibited.

Modules 54 or LED strips 52 mounted to back shoulder pads 18 are typically used for locating others or safety purposes. These modules 54, LED strips 52, can be set on strobe or constant light mode to provide a signal beacon to others that someone is ahead, either to warn the others to stay clear or to help them locate the wearer.

Making individuals visible in dangerous settings where visibility is poor is a feature of the present invention. Unlike reflector vests that need light to reflect light, light modules 54 and LED strips 52 emit light that can be easily seen at a distance. Police, EMS personnel, fire fighters, and road crews are visible with vest 10 as they perform their duties at road side. They also have use of hands-free task lighting and can reposition the light modules of the harness vest to a position where the light falls on the work area.

Those skilled in the art of service lighting and portable lighting will readily appreciate that many modifications and substitutions may be made to the foregoing preferred embodiments without departing from the spirit and scope of the present invention, which is defined by the appended claims.

What is claimed is:

1. A device, comprising:

(a) a harness vest having a left front shoulder pad, a right front shoulder pad, a left rear shoulder pad and a right rear shoulder pad and operable be worn only on an upper torso of a user so as to cover only a left front, a right front, a left rear and a right rear of a wearer;

(b) lighting carried by said harness vest on said left front, right front, left rear and right rear shoulder pads;

(c) control functions for said lighting enabling said lighting to light continuously, to strobe, and to vary in brightness;

(d) a battery carried by said harness vest in electrical connection with said lighting and said control functions; and (e) a breakaway reflector vest and reflector cover attachable to said harness vest.

2. The device as recited in claim 1, wherein said lighting includes removable lighting modules.

3. The device as recited in claim 1, wherein said lighting have a magnetic backing.

4. The device as recited in claim 1, wherein said lighting includes LED light strips.

5. The device as recited in claim 1 wherein said left rear shoulder pad and said right rear shoulder pad are connected by a ring connector.

6. The device as recited in claim 1, wherein said left rear shoulder pad and left front shoulder pad are connected with side adjustments straps and quick-release connectors.

7. The device as recited in claim 1, further comprising a battery pack housing said battery that is in electrical connection with said lighting and said controls, said battery having a USB charging port.

8. The lighting system as recited in claim 1, wherein said left front shoulder pad and said right front shoulder pad carry on/off buttons, said on/off buttons being in electrical connection with said lighting of said left front shoulder pad and said right front shoulder pad, and said left rear shoulder pad and right rear shoulder pad, respectively.

9. The device as recited in claim 1, wherein said light modules are plural LEDs.

10. The device as recited in claim 9, wherein said LEDs in said light modules are operable to change color in response to said control functions.

11. The device as recited in claim 10, wherein said LEDs of said light modules are ultra-bright LEDs.

12. A device, comprising:

(a) a harness vest having a left front shoulder pad, a right front shoulder pad, a left rear shoulder pad and a right rear shoulder pad operable to be worn on the upper torso of a user so as to cover only the left front, right front, left rear and right rear of the upper torso of the wearer;

(b) removable LED modules carried by said harness vest on said left front shoulder pad and right front shoulder pad;

(c) control functions for said LED modules enabling said LED modules to light continuously, to strobe and to vary in brightness;

(d) a battery carried by said harness in electrical connection with said LED modules and said controls functions;

(e) a breakaway reflector vest and reflector cover attachable to said harness vest.

13. The device of claim 12, wherein said right front shoulder pad carries an on/off button.

14. The device of claim 12, wherein said left rear shoulder pad and said right rear shoulder pad are connected by a ring connector and said left rear shoulder pad and said left front shoulder pad are connected by a left side adjustment strap, and said right rear shoulder pad and said right front shoulder pad are connected by a right side adjustment strap.

15. The device of claim 12, wherein said left rear shoulder pad and said right rear shoulder pad of said harness carry LED light strips.

16. The device of claim 15, wherein LEDs in said LED light strips are red, green, yellow and blue.

17. The device of claim 15, wherein said right front shoulder pad carries an on/off button for said LED strips and said left front shoulder pad carries an on/off button for said LED strips.

* * * * *